United States Patent [19]

Immonen

[11] Patent Number: 4,899,679

[45] Date of Patent: Feb. 13, 1990

[54] KEEL STRUCTURE

[75] Inventor: Henrik Immonen, Tampere, Finland

[73] Assignee: Sarvis Oy, Tampere, Finland

[21] Appl. No.: 253,821

[22] Filed: Oct. 6, 1988

[30] Foreign Application Priority Data

Oct. 6, 1987 [FI] Finland ..... 874384

[51] Int. Cl.[4] ..... B63B 3/38

[52] U.S. Cl. ..... 114/39.1; 114/140

[58] Field of Search ..... 114/140, 125, 288, 290, 114/39.1

[56] References Cited

U.S. PATENT DOCUMENTS

| | | | |
|---|---|---|---|
| 1,202,713 | 10/1916 | Hedges | 114/140 X |
| 1,712,167 | 5/1929 | Pontikis | 114/140 X |
| 2,570,595 | 10/1951 | Romero | 114/140 X |
| 3,885,514 | 5/1975 | Lauenborg | 114/288 |

FOREIGN PATENT DOCUMENTS

| | | |
|---|---|---|
| WO82/00447 | 2/1982 | PCT Int'l Appl. . |
| WO83/00129 | 1/1983 | PCT Int'l Appl. . |
| 27702 | 12/1908 | Sweden . |
| 34928 | 5/1922 | Sweden . |
| 1169266 | 11/1969 | United Kingdom . |

*Primary Examiner*—Sherman D. Basinger

*Attorney, Agent, or Firm*—Pollock, Vande Sande & Priddy

[57] ABSTRACT

A keel structure connected to the hull of a nautical vessel, such as a sailboat, is provided at least at the junction of the vessel hull and the keel with at least one channel extending substantially lengthwise of the keel for guiding the water displaced by the keel at least partially past a zone, which extends longitudinally of the hull and is aligned with the keel, without lifting it to the surface of water.

5 Claims, 4 Drawing Sheets

KEEL STRUCTURE

BACKGROUND OF THE INVENTION

The present invention relates to a keel structure in connection with the hull of a nautical vessel, such as a sailboat.

In principle, there are two basic keel designs: a fin keel which is fastened to the hull of a boat and can also be liftable, and a displacement keel in which the hull of a boat is expanded to form a keel fin. It is obvious that the hull may include several keels. The keel structure usually contains an additional ballast, such as iron or lead.

A purpose of the keel especially on a sailboat is to counterbalance the effect of a lifting lateral force directed to the hull of a boat from the sails as well as to counteract the inertia of a boat. Similar functions are also assigned to a possible additional fin and to the rudder. The main purpose of the rudder is, however, to provide the lateral force required for steering the boat. The deeper or heavier the keel, the greater the boat-trueing moment. In addition to the above, the practical dimensioning of a keel is effected by the strength required of the keel, particularly at the junction of the hull and the keel against momentary dynamic lateral forces, With the exception of light jollies, in which the main purpose of the keel is to prevent the leeway, the crew themselves acting as a counterforce to the force exerted by the sails, the keel must be designed to be more or less wide in the crosswise direction of the hull. Thus, the keel should be designed in such a manner so as to be minimized that the drag caused thereby would be as little as possible. The presently used designs aim to minimize the turbulence of by-pass current and the friction surface (wet surface). A preferred shape of the keel keel must naturally be as streamlined as possible.

Since water is an incompressible fluid, the keel of a sailboat acts the same way as a displacement pump, such that the effect taken up thereby (without friction effect) is a function of the largest cross-sectional area of a keel, the mean draft thereof and the speed of a boat.

The displacement pumping effect taken up by the boat has an effect on the speed of the boat particularly at low speeds, whereby other features of the boat, such as the length of the hull, have no effect on its speed.

Hereinbelow is a list of the components which build up the advancing resistance of a boat:

the pumping effect developed by the displacement of the keel and the hull of a vessel, which effect depends on the largest cross-sectional area of the advancing direction of a boat, the mean draft of this cross-sectional area, and the speed of the boat, the advancing resistances of displaced water masses (the rise of water masses to water surface), the friction between the hull and the keel of the vessel and water, and the air drag caused by the above-water components and structures of the vessel.

It can be shown by calculations that the most important of these are the displacement pumping effect and the flow losses of displaced water masses.

At present, design of the hull and keel of a vessel has to a great degree developed experimentally. Experimentally well-found designs have been used and theoretical basis is generally poor. Flow analyses are highly complex even though the question is about an incompressible fluid. It should also be noted in practice that the disturbance components caused by the waves complicate calculations. Thus, it can be concluded that presently, the designing and constructing of sailboats and in particular their keels are to a great degree based on traditional and previously used structural possibilities and minor improvements thereof. No attention has been paid to the actual basic problem, that is the displacement pumping effect caused by the displacement of a boat.

The crosswise surface area of the displacement of the hull and keel of a vessel relative to travelling direction can be divided into two components: hull and keel (also fin/fins and rudder). With a displacement type of keel, the keel is determined so as to begin at that point on a hull at which the inclination of bottom exceeds 45°. The amount of water displaced by the hull of a vessel is usually greater than that displaced by the keel. The displacement pumping effect caused by the hull of a vessel is not dealt with in this invention. The largest surface area of a keel (fin/fins and rudder) transverse to the travelling direction of a vessel is generally substantially smaller than the corresponding transverse surface area of the hull of a vessel. It is obvious, however, that the mean drafts of these surface areas are different. The mean draft of the transverse hull area of a vessel is considerably lower than the mean draft of the transverse keel area. Thus, the relative significance of the keel in terms of displacement pumping effect increases, since the required lifting distance is greater.

Thus, it is important that the displacement pumping effect in a keel structure be taken into consideration and, for this part, the displacement pumping effect can be eliminated totally or partially by means of controlled steering of water. In this context, it is possible to refer to pump analogy, the total lifting height of a pump being determined by the fall between the end of a pressure-side pipe and the pump regardless of the shape of the pipe. This, of course, on the condition that a flow friction of the pipe is ignored.

Publications WO-82/00447 and WO-83/00129 can be cited for describing the prior art. The former discloses a solution for decreasing the advancing resistance of a vessel by narrowing the sides of the hull of a vessel. The solution is based on the fact that, as it increases, the speed of a vessel with reach a range wherein the hull length of a vessel determines a so-called critical speed for the boat. By narrowing the sides of a hull it is possible to produce a more preferable surface wave and hence a more favorable speed within the critical speed range of a boat. On the other hand, the power demand of a displacement pumping effect caused by the keel is linear with the speed of a vessel. Most benefits in the solution are obtained at low speeds since other resistances or drags of the vessel are exponential relative to speed. The latter primarily deals with a rudder structure which is hollow in a manner that the cross-sectional area diminishes from forward edge to trailing edge. The side of a rudder, adjacent to the trailing edge, is provided with an array of holes whose purpose is to provide an improved flow to the draft side of a rudder in order to avoid flowing disturbances on the draft side of a rudder. A premise in the latter solution is also that incompressible water behaves the same way as compressible air.

SUMMARY OF THE INVENTION

An object of this invention is to provide a keel structure whereby the water displaced by a keel can be controllably steered past it, so that at least a considerable part of the displacement pumping effect of the keel can be eliminated and a boat-slowing counterforce can be limited or the lifting height of the displacement pumping effect of the keel can be maintained as low as possible.

In order to achieve this objective, a keel structure of the present invention is provided, at least at the junction of the vessel hull and the keel, with at least one channel and/or chute extending substantially lengthwise of the keel for passing the water displaced by the keel at least partially past a zone, extending lengthwise of the hull and arranged in alignment with the keel, without lifting it to the surface of water.

The inlet of such channel and/or chute is provided essentially on the leading edge of a keel and the outlet on the trailing edge. If a keel is designed with leading and/or trailing edge zones having substantially small transverse cross-sectional areas, the inlet and outlet can be made in the lateral faces of a keel, whereby it is possible to observe a substantial part of the displacement pumping effect in a surface area transverse to the direction of a keel within the central keel portion.

The cross-sectional area of the at least one channel and/or chute extending longitudinally of a keel is preferably not greater than the largest cross-sectional area of the keel. Naturally, the cross-sectional area of the channel and/or chute can also be smaller than the largest cross-sectional area of the keel. Thus, the flow rate in the channels/chutes increases and some of the displaced water rises up to surface, whereby the beneficial effect of the invention is only achieved partially. The solution only decreases the lifting height of a displacement pumping effect to be equal to the fall between the mean draft or immersion of a keel and the outlet of the channel and/or chute. Thus, the primary object of this keel structure is not to achieve as laminar a by-pass flow of water as possible on the keel surface but a controlled passage of displaced water past a keel in a manner that the water is returned nearly to the original depth level so that the lifting height of displacement pumping effect is to be minimized.

A keel structure of the invention will not be illustrated in the following specification with refernece made to the embodiments shown in the accompanying drawings. In the darwings

DETAILED DESCRIPTION OF THE PREFERRED EMBODIMENT(S)

Figure 1:
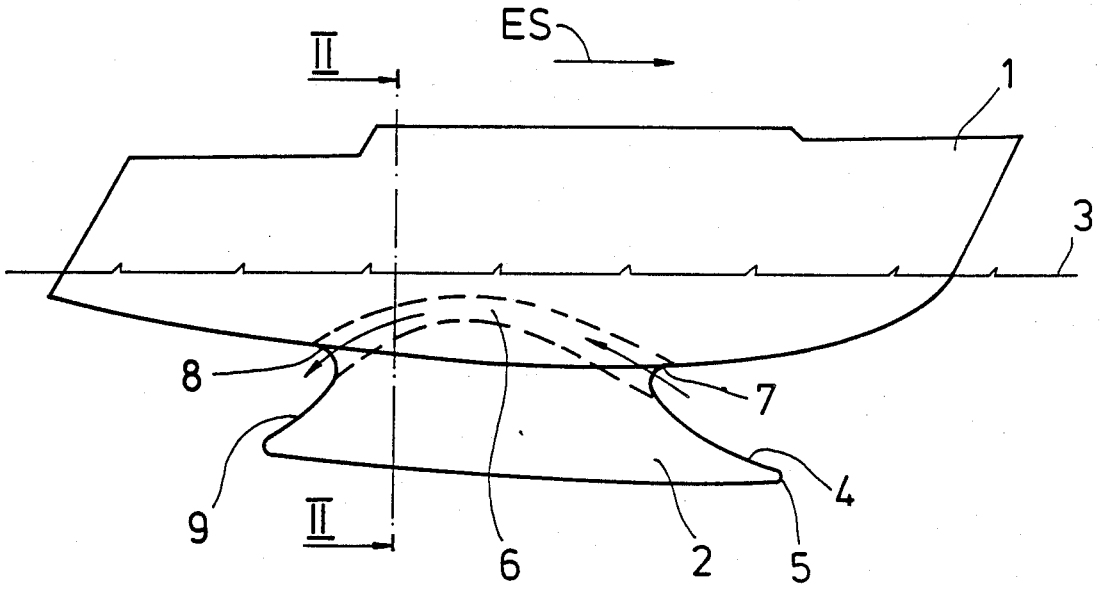
FIG. 1 is a side view of a first embodiment of a keel structure of the present invention.
Figure 2:
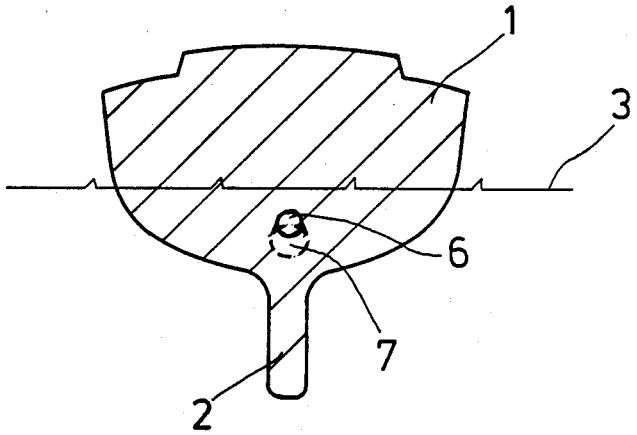
FIG. 2 is a section taken along lines II—II of FIG. 1.

Referring to the drawings, the hull of a vessel, such as a sailboat, is generally designated by reference numeral 1 and the keel by reference numeral 2. Water level is designated by reference numeral 3.

FIG. 1 illustrates the theoretically optimum solution for a keel structure of the present invention. The leading edge 4 of a keel structure 2 is preferably designed as a wedge-shaped guide surface which climbs from a gentle keel point 5 towards the inlet 7 of a channel 6. Hence, the water displaced a keel rises up leading edge 4 in a direction opposite to the advancing direction (arrow ES) towards inlet 7 of channel 6. Channel 6 is built inside hull 1 and is curved or straight as shown in FIG. 1. The outlet 8 of channel 6 is in the top portion of the trailing edge 9 of keel 2 at the junction of hull and keel. The trailing edge 9 of keel 2 is designed to be substantially symmetrical relative to leading edge 4 in such a fashion that the water flowing out of outlet 8 passes along the trailing edge slopingly downwards and rearwards longitudinally of hull 1. In a side view, this type of keel structure can be described as a kind of dovetail structure. The displacement pumping effect is thus totally (except for flow losses and friction losses of the channel) eliminated since the displaced water is returned to exactly the same height level as it has flown through channel 6. A condition of this is naturally that the cross-sectional area of channel 6 corresponds overall or for a significant part to the largest cross-sectional area of the keel in a direction perpendicular to the advancing direction (arrow ES). It is possible that this type of structure has certain drawbacks especially in terms of strength, for example when running aground, but certain special structures could probably be used to mitigate or completely eliminate such drawbacks. In this connection these structural alternatives are not explained in detail as they do not belong within the scope of this invention.

Figure 3:
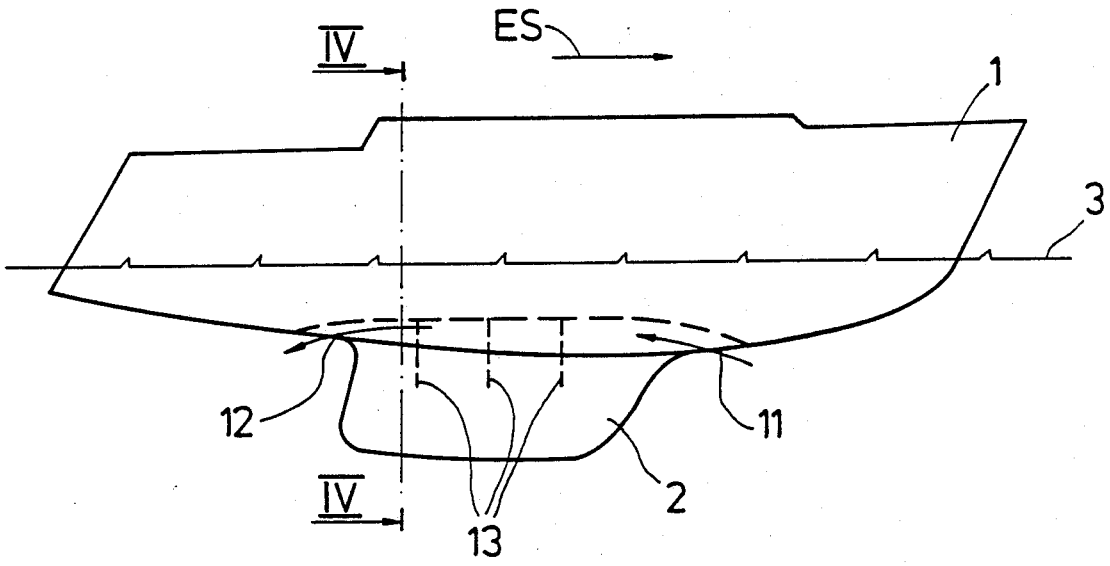
FIG. 3 is a side view of a second embodiment of a keel structure of the present invention.
Figure 4:
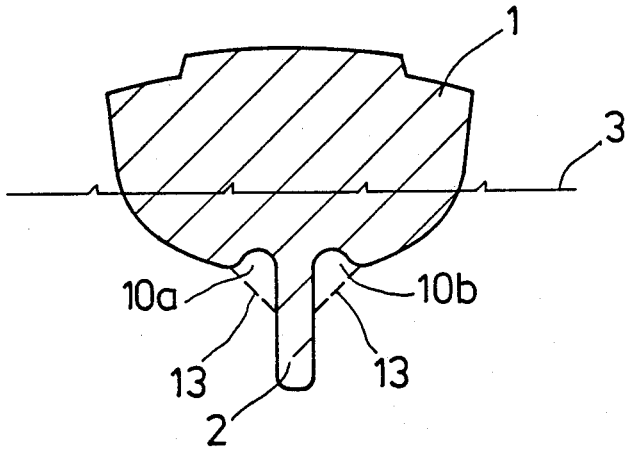
FIG. 4 is a section taken along lines IV—IV of FIG. 3.

FIGS. 3 and 4 illustrate one embodiment of the invention as applied to a traditional hull and keel structure. In this solution, the junction of hull 1 and keel 2 is provided with two chutes **10*a* and 10*b* extending longitudinally of the hull on either side of keel 2. The water displaced by keel 2 passes into these chutes through an inlet 11 aligned with the leading edge and discharges through an outlet 12 aligned with the trailing keel edge. The design of such chutes and the selection of cross-sectional area are associated with overall vessel design, particularly on the basis of strength and other required properties. It is self-evident that between the lateral faces of hull 1 and keel 2 can be inserted reinforcements, for example reinforcing plates, as shown by dash-and-dot lines 13 in FIGS. 3 and 4**.

The displacement pumping effect can be at least substantially decreased by means of a chute solution shown in FIGS. 3 and 4.

Figure 5:
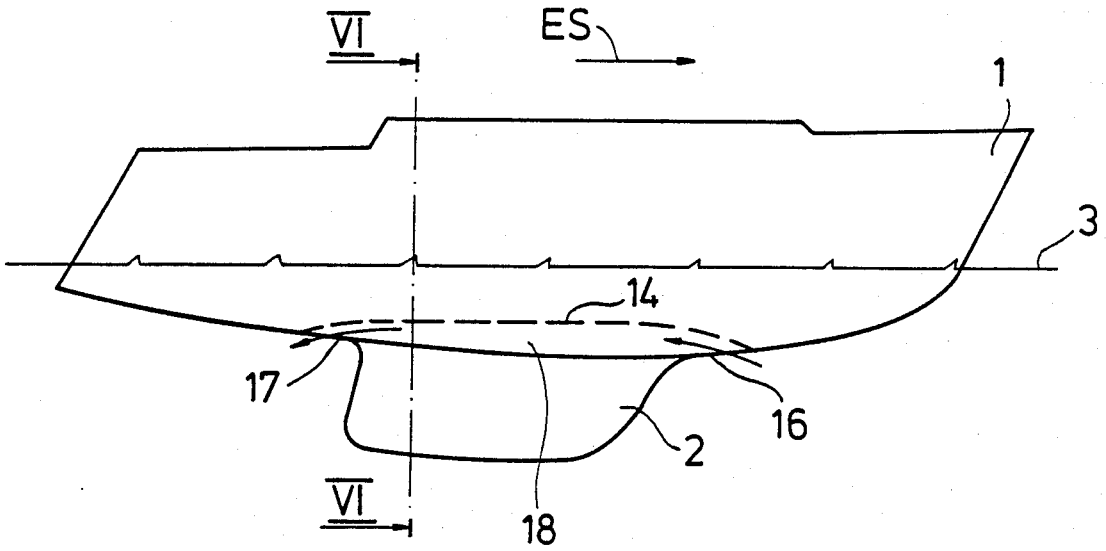
FIG. 5 is a side view of a third embodiment of a keel structure of the invention.
Figure 6:
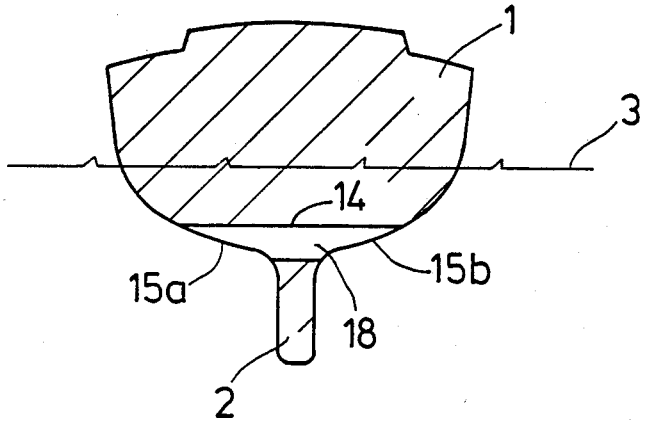
FIG. 6 is a section taken along lines VI—VI of FIG. 5.

FIGS. 5 and 6 illustrate one embodiment of a keel structure of the invention that can be used with minor modifications in some presently available sailboat models. The interior floor of a sailboat is provided by a horizontal base plate 14 (FIG. 6) and in conventional solutions the sections **15*a* and 15*b* of hull 1 joined directly to the keel on either side thereof, together with hull plate 14, provide a substantially triangular space which extends longitudinally of the hull and is left empty in the present solutions. This space can be used as a channel of the invention by providing the leading edge of keel 2 with an inlet 16 and the trailing edge thereof with an outlet 17 and by designing a channel 18 in said space. The solutions is very simple. It is obvious that keel 2 need not be braced to hull sections 15 and 15*b* but also directly to hull plate 14** to form two separate channels on either side of the keel.

Figure 7:
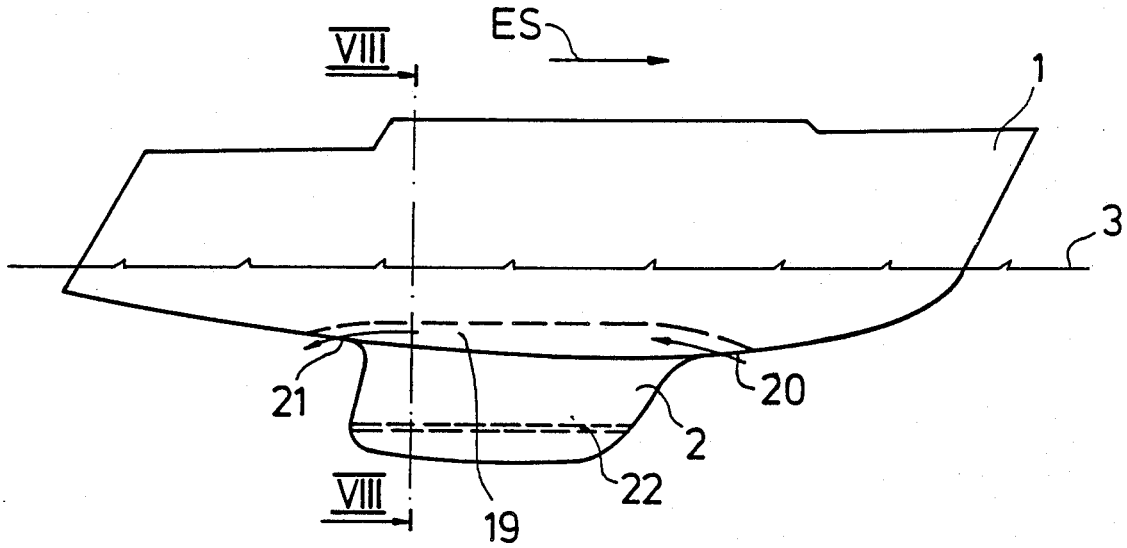
FIG. 7 is a side view of a fourth embodiment of a keel structure of the present invention.
Figure 8:
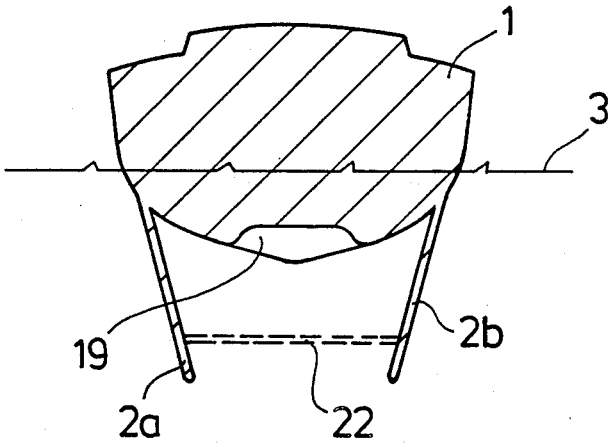
FIG. 8 is a section taken along lines VIII—VIII of FIG. 7.

FIGS. 7 and 8 show one embodiment of a keel structure of the invention for a keel with two or more fins. In this solution, There is one longitudinal chute 19 made between keels **2*a* and 2*b* (of course there can be more than two of these chutes). The water displaced by keels 2*a* and 2*b* passes into this chute 19 whose inlet 20 is aligned with the leading keel edge and outlet 21 with the trailing keel edge. The design of such chutes and the selection of their cross-sectional area is associated with overall boat design, especially on the basis of strength and other required properties. It is obvious that between the keels (or keel points) can be positioned at least one reinforcement, shown by dash-and-dot lines in FIGS. 7 and 8** and possibly equipped with extra weights.

It is clear that, in addition to the above structural solutions and within other structural and strengthwise requirements, a keel can be provided as such with one or a plurality of channels which allow the direct flow-through of displaced water through a keel. This is preferable in cases when, for structural or other reasons, the junction of hull 1 and keel 2 cannot be provided with a channel whose cross-sectional area corresponds to that of the keel.

It is obvious that a variety of embodiments can be designed within the scope of the invention. The solutions described are just examples and combinations thereof can be used on one and the same keel structure.

I claim:

1. A keel structure for a nautical vessel having a hull, said keel structure comprising:

a keel projecting downwardly from the bottom of the hull, said keel extending along a portion of the length of said hull, said keel having a leading edge provided at one end, and a trailing edge provided at the opposite end thereof;

at least one channel formed substantially inside said hull and extending in a lengthwise direction of said hull;

said channel having an inlet opening formed in said keel at the junction of said end forming said leading edge to the bottom of said hull, and an outlet opening formed in said keel at the junction of said end forming said trailing edge to the bottom of said hull;

said leading edge including a first wedge-shaped guiding surface converging towards said inlet location and said trailing edge including a second guiding surface sloping downwardly from said outlet location and substantially corresponding in shape to said first guiding surface; and said first guiding surface directing the water displaced by said keel towards said inlet and said second guiding surface directing the water from said outlet downwardly and rearwardly longitudinally of said hull.

2. In a sailboat having a hull and a keel member having a top wall interconnected with said hull to project downwardly from the bottom of said hull in a lengthwise direction of said hull, said keel member comprising:

first and second opposite end walls;

at least one channel having a first opening in said first end wall of said keel member and a second opening in said second end wall, both openings being positioned next to said bottom of said hull, said at least one channel extending substantially inside said hull in the lengthwise direction of said hull;

said first end wall defining a first substantially wedge-shaped guide surface, said second end wall including a second guide surface substantially corresponding in shape to said first guide surface;

said first guide surface being adapted for directing the water towards said first opening; and said second guide surface being adapted for directing the water from said second opening downwardly and rearwardly longitudinally of said hull.

3. A keel structure as claimed in claim 1, wherein the crosswise area of said at least one channel substantially corresponds to the largest crosswise area of said keel.

4. A keel structure as claimed in claim 3, wherein said inlet is positioned substantially at the same height level as said outlet.

5. A keel structure as claimed in claim 1, wherein said inlet is positioned substantially at the same height level as said outlet.

* * * * *